US011825948B1

(12) United States Patent
Stuckenschneider et al.

(10) Patent No.: US 11,825,948 B1
(45) Date of Patent: Nov. 28, 2023

(54) FURNITURE ARTICLE HAVING PANELS WITH EMBEDDED MAGNETS

(71) Applicant: Loftwall, Inc., Grand Prairie, TX (US)

(72) Inventors: Bryce Stuckenschneider, Fort Worth, TX (US); Jonathon Kemnitzer, Kansas City, MO (US)

(73) Assignee: Loftwall Inc., Grand Prairie, TX (US)

( * ) Notice: Subject to any disclaimer, the term of this patent is extended or adjusted under 35 U.S.C. 154(b) by 0 days.

(21) Appl. No.: 17/533,438

(22) Filed: Nov. 23, 2021

(51) Int. Cl.
*A47B 97/00* (2006.01)

(52) U.S. Cl.
CPC ..... *A47B 97/00* (2013.01); *A47B 2200/12* (2013.01)

(58) Field of Classification Search
CPC ..... A47B 97/00; A47B 2200/12
See application file for complete search history.

(56) References Cited

U.S. PATENT DOCUMENTS 2,942,924 A * 6/1960 Stangert ..... A47B 21/03 312/196
3,053,601 A * 9/1962 Korling ..... A47F 5/005 312/140.3
5,890,782 A * 4/1999 Alberts ..... A47B 17/00 312/258
11,375,808 B1 * 7/2022 Dawson ..... A47B 83/001
2002/0189506 A1 * 12/2002 Hamilton ..... A47B 17/033 108/50.02
2012/0304441 A1 * 12/2012 Henriott ..... A47B 13/00 29/428
2017/0328127 A1 * 11/2017 Stathis ..... F21S 6/003
2019/0365101 A1 * 12/2019 Udagawa ..... A47B 21/00
2020/0224693 A1 * 7/2020 Klingler ..... A47B 83/001
2020/0288867 A1 * 9/2020 Knapp ..... A47B 96/20
2021/0330098 A1 * 10/2021 Udagawa ..... A47B 96/20
2022/0167744 A1 * 6/2022 Paulucci ..... A47B 97/00
2022/0175130 A1 * 6/2022 Reddig ..... A47B 9/20

FOREIGN PATENT DOCUMENTS

DE 202020002561 U1 * 8/2020
DE 102020104568 A1 * 8/2021

* cited by examiner

*Primary Examiner* — Daniel J Rohrhoff
(74) *Attorney, Agent, or Firm* — James E. Walton

(57) ABSTRACT

A furniture article includes a first panel and a second panel. The panels are positioned adjacent each other, having one or more panel fasteners therebetween. The panel fasteners include embedded magnets. The panels are positioned relative to a working surface, and are positioned such that each of the panel fasteners is hidden from view.

7 Claims, 9 Drawing Sheets

FURNITURE ARTICLE HAVING PANELS WITH EMBEDDED MAGNETS

BACKGROUND

1. Field of the Invention

The present invention relates in general to the field of furniture, and more specifically to furniture having panels or privacy screens with mounting systems for adjustable, acoustic, or aesthetic dividers.

2. Description of Related Art

Privacy screens, dividers, panels, and barriers are often used in offices, sound studios, dressing rooms, libraries, and schools. These partitions are often selected with a single purpose in mind. For example, partitions in offices and schools are usually selected for their ability to divide a room into multiple spaces; while partitions in sound studios may be selected for noise reduction and acoustic variation.

Partitions may be heavy, bulky, or are configured as free-standing structures. When attached to a wall or the floor, the partitions are often non-adjustable, permanently affixed, or include visible or protruding fasteners that may snag apparel and other objects in close proximity to the fasteners of the partitions. Although some fixed partitions have removable fasteners, the heads, studs, or other parts of the fasteners wear out over time, requiring multiple fastener replacements.

Although some partitions are mobile, such as those used to form office cubicles, these partitions usually still fail to provide additional uses beyond dividing the room into multiple office spaces. Additionally, these dividers generally do not include working surfaces, or are limited to specific types of working surfaces with wire ports or holes for computer cables and phone wires.

Generally, partitions are also useful in preventing communicable diseases by reducing human contact and airborne pathogens. However, current medical partitions are limited in their mobility, aesthetics, noise reduction, and use variations.

Thus, there exists significant room for improvement in the art for increasing the mobility, aesthetics, noise reduction qualities, and use variations of partitions. There also exists a need for preventing or reducing the disadvantages of current partitions, including protruding and visible fasteners, creating permanent fixtures, and limiting overall working space.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
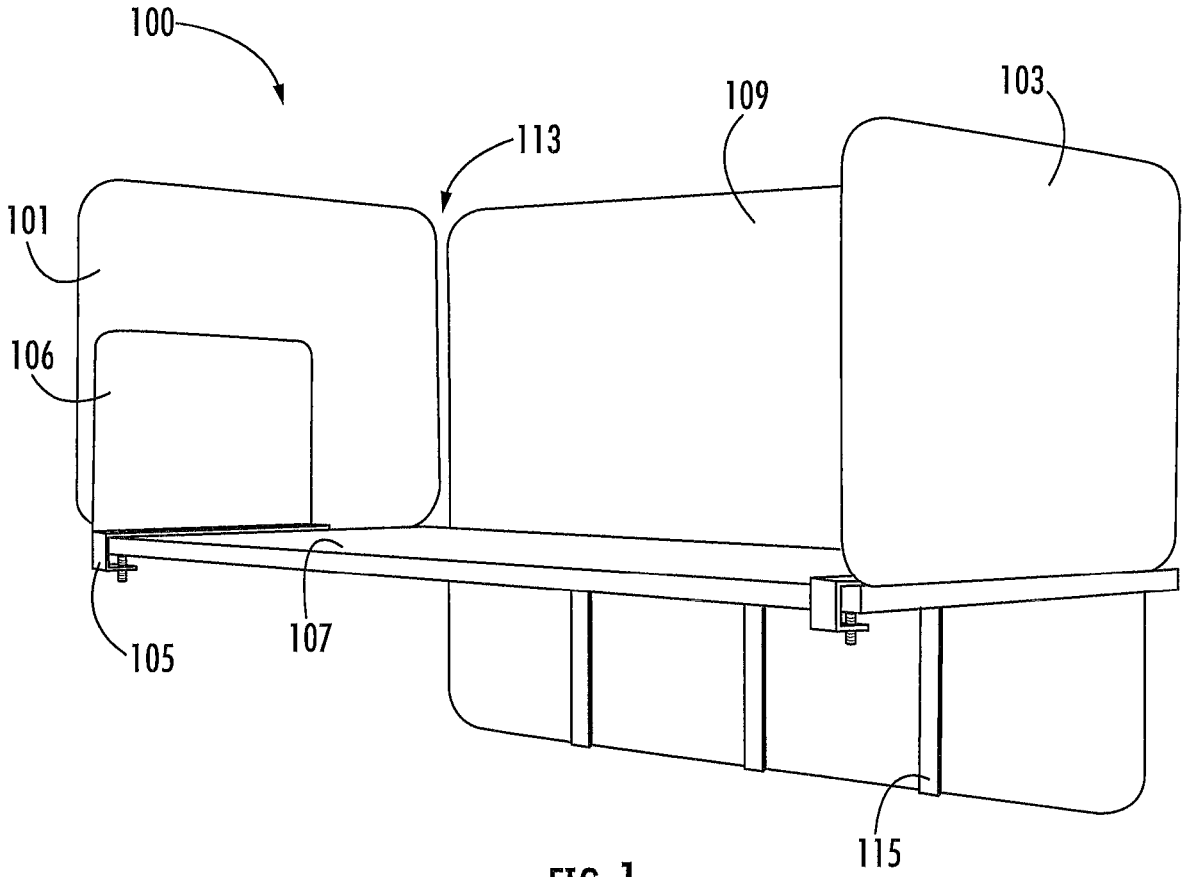
FIG. 1 is a perspective view of a furniture article having panels, according to the present application.

While the assembly of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the furniture article and panels with features including mobility, adjustability, adaptability, aesthetics, noise reduction qualities, and use variations of partitions are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

As used herein the term "tuneability" refers to the ability of a panel to be selectively configured in multiple characteristics and qualities, including but not limited to its acoustic variation, aesthetics, magnetism, ability to receive fasteners such as tacks, and ability to be reconfigured.

Referring now to FIG. 1 in the drawings, a perspective view of the preferred embodiment of a panel fastening system 100 for use with furniture is illustrated. System 100 having panels 101 and 103 and a panel fastener 105 according to the present application are illustrated. Preferably, panels 101 and 103 comprise a semi-rigid, thermoplastic polymer resin, such as a polyethylene terephthalate (PET or PETE) having discrete dimensions. Alternatively, other semi-rigid materials may be used, such as nylon, polycyclohexylenedimethylene terephthalate (PCT), other thermoplastic polyesters, thermoplastic resins, plastic, wood, composites, or other lightweight materials. In at least one embodiment, panels 101 and 103 are made of a material that can be sprayed with chemicals, such as disinfectants, cleaners, water, and other liquids without damaging the panel.

Preferably, the panels 101 and 103 are "tuneable". For example, with respect to aesthetics, dyes or other pigments are dispersed in the initial stage of synthesizing PET to add color to the core of the panels 101 and 103. Additional coloring variations occur as an exterior material is placed over a surface of a panel. The exterior material is preferably a felt material, but might also include wool, vinyl, and textile materials. The exterior material is selectively chosen for its aesthetic or acoustic qualities, and may include additional layers beneath the exterior to help achieve this selection. For example, foam padding, wool batting, cotton fiber batting, synthetic batting, cork board, or other flexible and semi-rigid layers may be attached beneath the exterior to increase noise reduction abilities. These layers may also aid in the ability of the panel to receive fasteners, such as tacks. Hook and loop tape is also attached or adhered to portions of the panel to provide additional organizing features.

Panel fastener 105 of system 100 is a first set of panel fasteners disposed between interior surfaces of panels 101 and 103, and is preferably configured as one or more clamps depending on a number of panels used in constructing the furniture article. Panels 101 and 103 are positioned adjacent, partially resting against, a work top 107. Working surface 107 is offset from another working surface, such as the ground or a floor. Preferably, panel fastener 105 is disposed beneath work top 107, such that panel fastener 105 is not visually perceptible or is hidden from view relative to a person sitting at and using work top 107.

Working surface 107 is made from any material common to desks, standing desks, drafting tables, and similar working surfaces. For example, work top 107 is made of wood, metal, plastic, nylon, resin, composites, and other materials.

Panel fastener 105 includes an interfacing facial support 106. Preferably, facial support 106 is a plate made from a ferrous material, such as steel, iron, alloys, and other metals of a specific carbon content. Facial support 106 is configured as a device organizer. For example, facial support 106 may be coated with a finish, such as a whiteboard finish, making at least its interior, or user-facing surface, a working surface that can be marked with dry-erase markers. Facial support 106 may receive magnets for holding papers, or is drilled to receive threaded and non-threaded fasteners. Although holes may be drilled in facial support 106, preferably no holes are drilled to enable smooth lateral sliding adjustments of panel 101 relative to facial support 106.

Although panel fastener 105 is depicted as a clamping fastener, other fasteners are encompassed in the present application. For example, a T-beam, or a beam having a T-slot formed therein, may be used together with a T-flanged vertical panel to form a panel support similar to the mounting system formed by panel fastener 105 and interfacing facial support 106.

Although panel fastener 105 is depicted as a left side fastener, the present application encompasses a right side fastener similar, if not identical to the left side fastener. The fasteners differ in that the right side fastener is oppositely oriented as compared to the left side fastener.

Furniture article 100 preferably includes a rear panel 109. Rear panel 109 is adjacent at least one of panels 101 and 103, having a disjointed corner 113 between it and the other panel(s). Although corner 113 is depicted as disjointed, it is important to note that corner 113 may be formed by joining a panel 101 or 103 with panel 109, such as with an exterior flexible layer, or perforations which make it possible to form corner 113 by bending. Corner 113 is preferably rectilinear, having a first panel perpendicular to a second panel, but may also be formed from one or more curved panels.

Rear panel 109 is held in position relative to work surface 107 by at least a second set of panel fasteners 115. Preferably, second set of panel fasteners are formed as a plurality of discrete clamping brackets, evenly distributed across an interior or user-facing surface of rear panel 109 and clamped to work top 107. Alternatively, the discrete clamping brackets could be formed as a single, unitary clamping bracket of a width that is generally wider than a width of a single, discrete clamping bracket.

Figure 2:
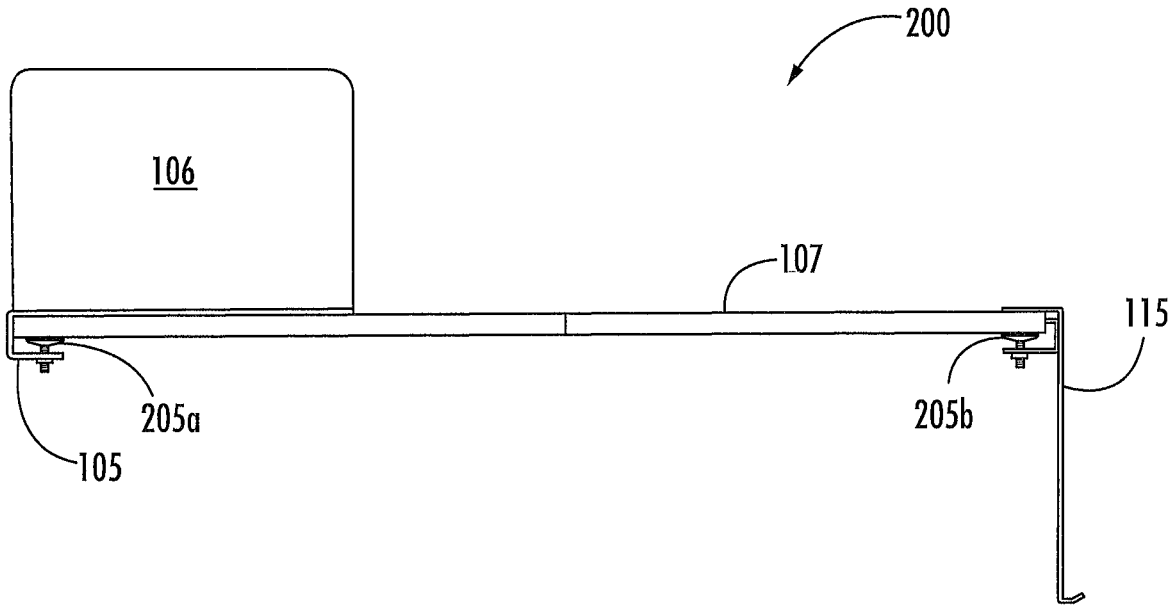
FIG. 2 is a side view of the mounting system of FIG. 1.
Figure 3:
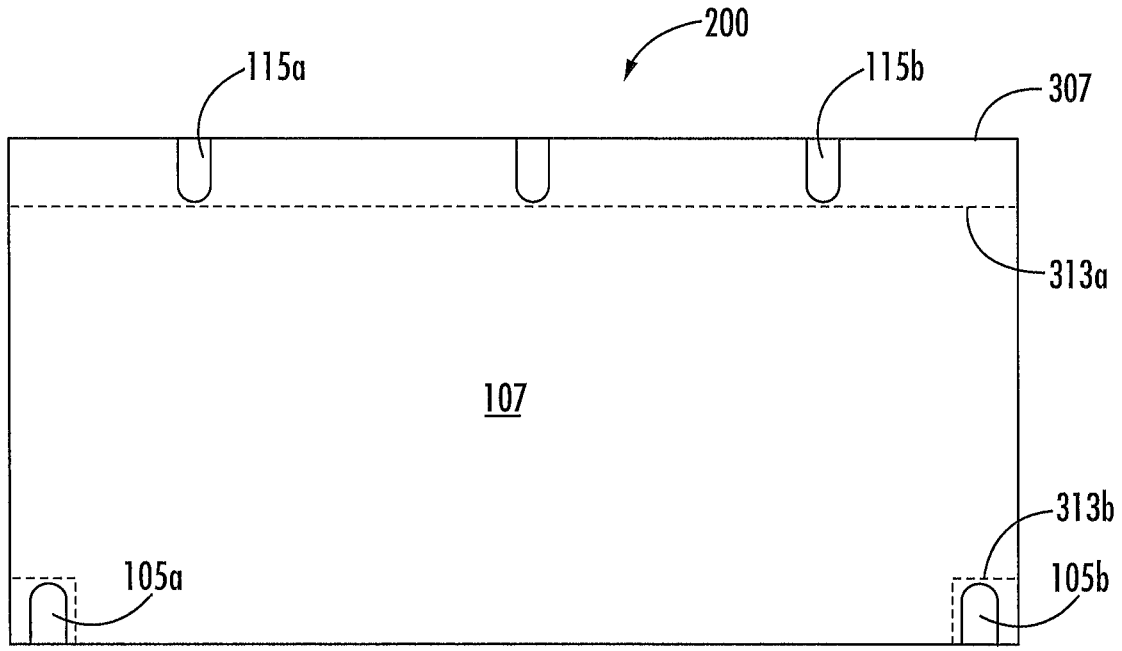
FIG. 3 is a bottom view of the mounting system of FIG. 1.

Referring now also to FIGS. 2 and 3 in the drawings, a side view and a bottom view of a mounting system 200 for system 100 is depicted. Mounting system 200 includes first set of panel fasteners 105 and second set of panel fasteners 115 attached to work station 107, Preferably, the panel fasteners are offset to provide multiple benefits. For example, a first panel fastener 105*a* of the first set of panel fasteners is offset from a second panel fastener 105*b* to adjust a dimension of available work top 107. A first panel fastener 115*a* of the second set of panel fasteners is offset from a second panel fastener 115*b* to provide stability to the support of rear panel 109. Each panel fastener of the second set of panel fasteners 115 is offset from an edge 307 of work top 107 to provide space for wires and cables. In at least one embodiment, work top 107 includes printed lines 313*a* and 313*b* to indicate superior attachment locations/areas for each set of panel fasteners.

Figure 4A:
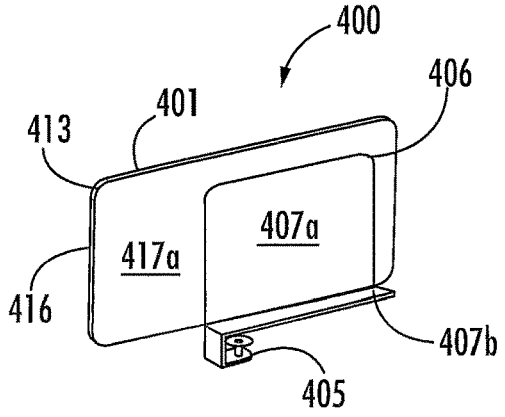
FIG. 4A a perspective back view of an alternative furniture article having a mounting system and panel, according to the present application.
Figure 4B:
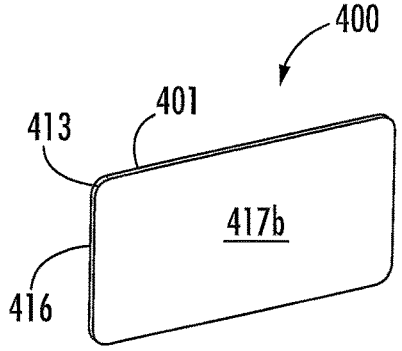
FIG. 4B is a perspective front view of the alternative furniture article of FIG. 4A.

Referring now also to FIGS. 4A and 4B in the drawings, perspective front-side and back-side views of an alternative furniture article 400 are depicted. Furniture article 400 includes panel 401 and panel fastener 405. Panel 401 includes a core 416 having rounded corners 413, a first side exterior surface 417*a* and a second side exterior surface 417*b*. Preferably, the side exterior surfaces 417 are felt coverings placed adjacent or on top of core 416. Preferably, core 416 is made of PET. Panel fastener 405 is positioned adjacent side exterior surface 417*a*, having interfacing facial support slidingly adjustable along side exterior surface 417*a*. Panel fastener 405 includes an upright portion 407*a*, which may be finished with a whiteboard finish, a base portion 407*b*, which provides structural support in holding panel fastener 405 against a working surface, such as work top 107, and a clamp member for clamping panel fastener 405 to work top 107. Magnets are positioned within core 416 to magnetically hold interfacing facial support 406 against panel 401. Base portion 407*b* may be configured as a tray for holding writing implements, such as dry-erase markers, pens, pencils, etc. Side exterior surfaces 417 are selectively configured to be tacked or have a specific acoustic quality.

Figure 5A:
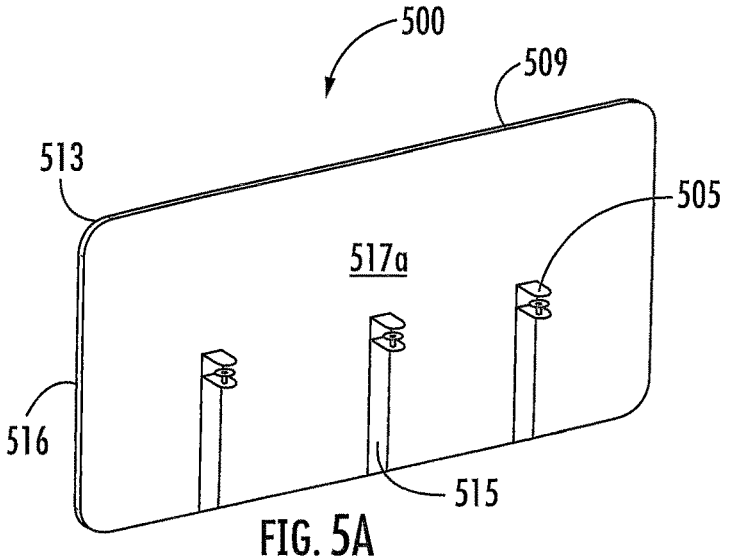
FIG. 5A is a perspective back view of another embodiment of furniture article having a mounting system and a panel, according to the present application.
Figure 5B:
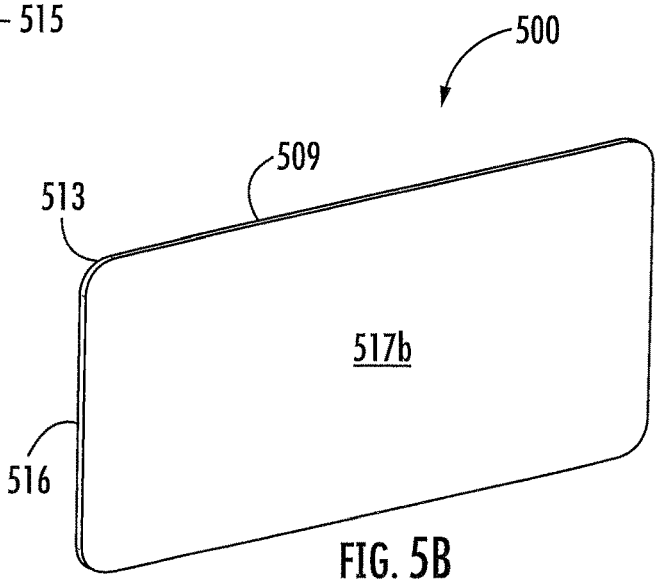
FIG. 5B is a perspective front view of the furniture article of FIG. 5A.

Referring now also to FIGS. 5A and 5B in the drawings, perspective front-side and back-side views of an alternative furniture article 500 are depicted. Furniture article 500 includes panel 509 and one or more panel fasteners 515. Panel 509 includes a core 516 having rounded corners 513, a front exterior surface 517*a* and a back exterior surface 517*b*. Preferably, the exterior surfaces 517 are felt coverings placed adjacent or on top of core 516. Preferably, core 516 is made of PET. Panel fastener 515 is magnetically held adjacent side exterior surface 517*a*. Exterior surfaces 517 are selectively configured to be tacked or have a specific acoustic quality.

Figure 6A:
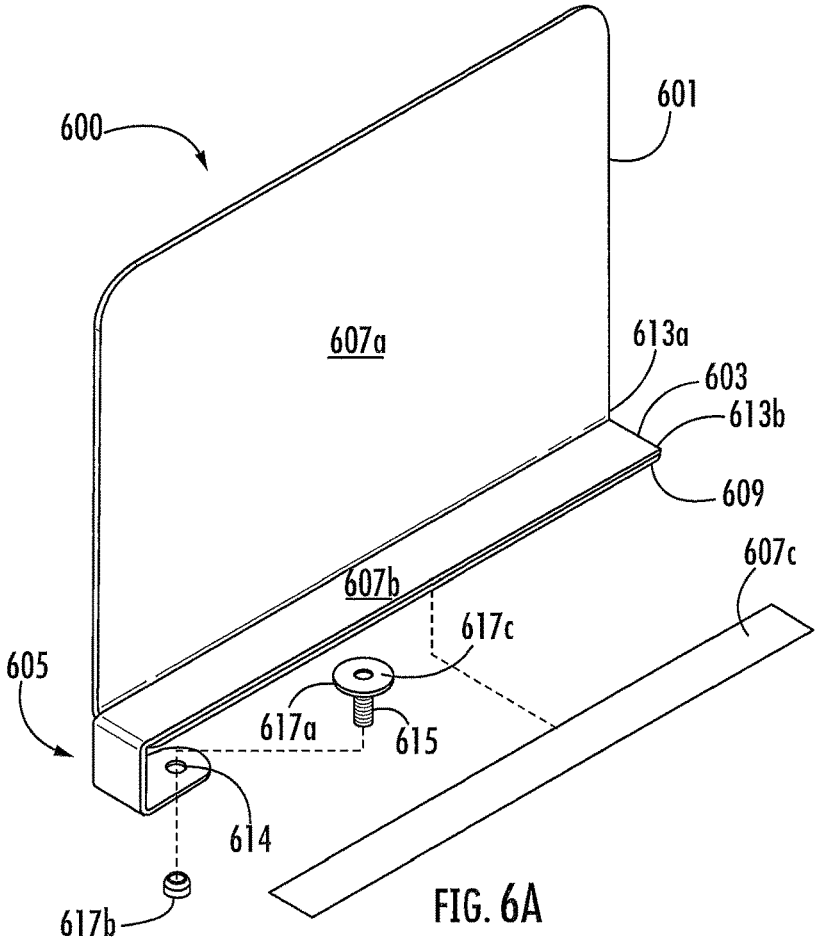
FIG. 6A is a perspective and partial assembly view of another embodiment of a furniture article, according to the present application.
Figure 6B:
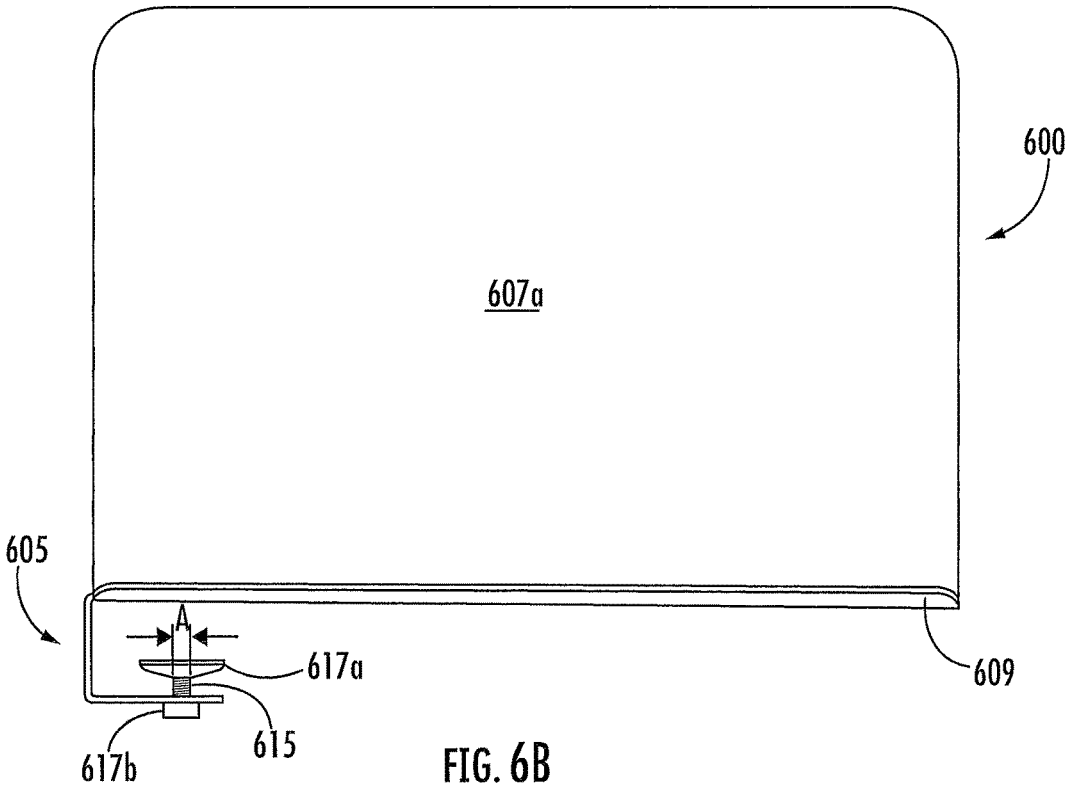
FIG. 6B is an assembled and side view of the furniture article of FIG. 6A.
Figure 6C:
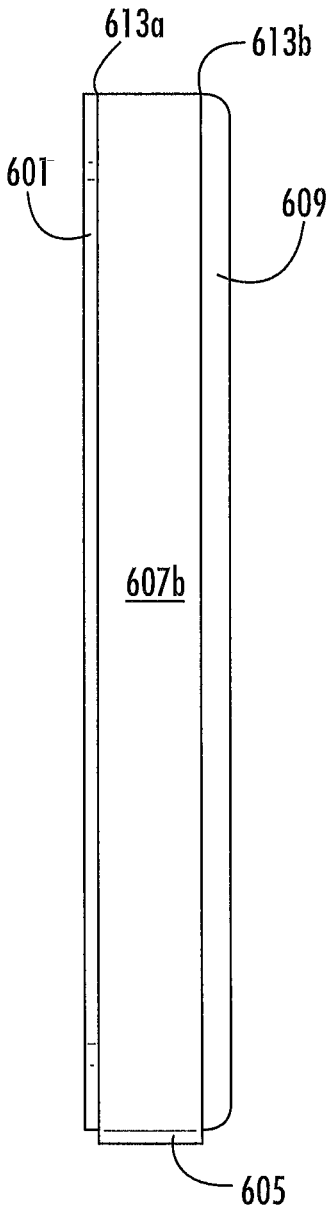
FIG. 6C is a top view of the furniture article of FIG. 6A.

Referring now also to FIGS. 6A-6C in the drawings, a furniture article 600 is depicted. Furniture article includes a vertical panel 601, a horizontal panel 603, a C-clamp 605, a first working surface 607*a*, a second working surface 607*b*, a third working surface 607*c*, and an angled panel 609. Vertical panel 601 is connected to horizontal panel 603 by first corner 613*a*, and horizontal panel 603 is connected to angled panel 609 by second corner 613*b*. Third working surface 607*c* is preferably cork board to cushion the attachment of furniture article 600 to a working surface, such as a desk. Alternatively working surface 607*c* is a rubber strip, padding, or double sided tape. C-clamp 605 includes an opening 614 of a dimension, A, that is commensurate with a diameter of spindle 615. Spindle 615 is attached to a swivel head 617*a* and nut 617*b*. Swivel head 617*a* has an interfacing surface 617*c*. In at least one embodiment, swivel head 617*a* includes an embedded permanent magnet for attachment to a metal desk.

Figure 6D:
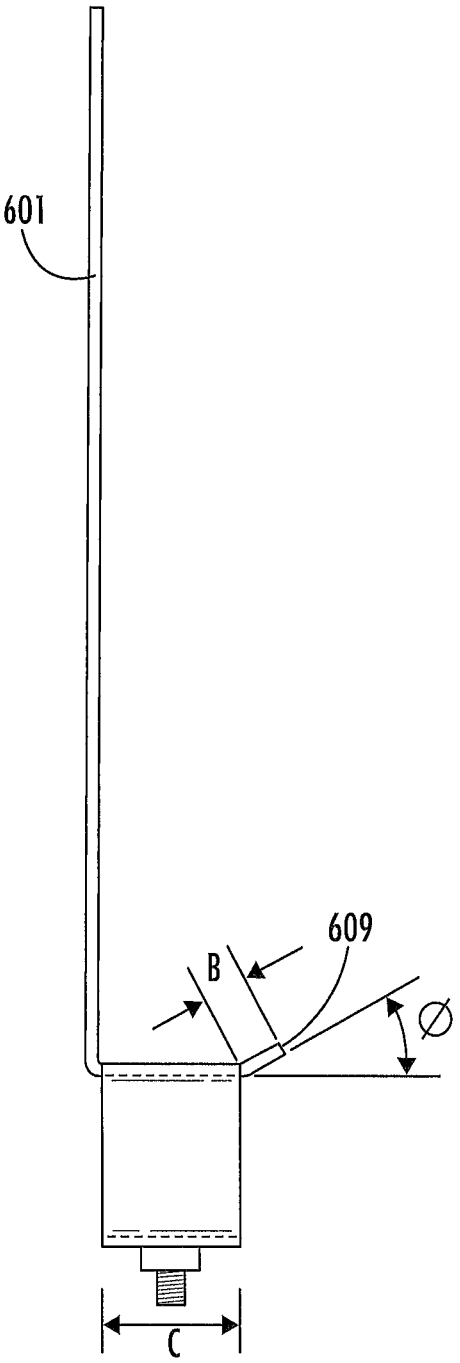
FIG. 6D is an end view of the furniture article of FIG. 6A.

Referring now also to FIG. 6D, angled panel 609 has a dimension, B, that is less than a dimension, C, of horizontal panel 603. Angled panel 609 is attached to horizontal panel 603 at an angle, Θ, where theta is preferably 30°, but may be any angle from greater than or equal to 1° to less than or equal to 90°.

Preferably, furniture article 600 is used as a panel support to support a panel, such as panel 101, however, it may also be a standalone article. Preferably, furniture article 600 is formed as a unitary structure, meaning it is bent, folded, or cut from a single piece of ferrous material. Alternatively, furniture article 600 includes multiple panels welded or otherwise attached together.

Referring now also to FIGS. 7A-7D in the drawings, a furniture article 700 is depicted. Furniture article includes a vertical panel 701, a horizontal panel 703, a clamping end 705 and a receiving end 709. Clamping end 705 includes a pad 707 to prevent damage to a desk to which the clamping end is attached. Clamping end 705 further includes an opening 714 of a dimension that is commensurate with a diameter of spindle 715. Spindle 715 is attached to a swivel head 717*a* and nut 717*b*. Swivel head 717*a* has an interfacing surface 717*c* that interfaces with pad 707 and the desk to which it is attached. Clamping end 705 further includes a spacer 718 formed, attached, or bent in an end of horizontal panel 703. Spacer 718 ensures spacing for wires and cables despite securing furniture article 700 to a desk. Horizontal panel 703 has a length of dimension, D, that is greater than or equal to the diameter of swivel head 717*a*, greater than or equal to a width, G, and less than or equal to a height, H. In at least one embodiment, swivel head 717*a* includes an embedded permanent magnet for attachment to a metal desk.

Figure 7B:
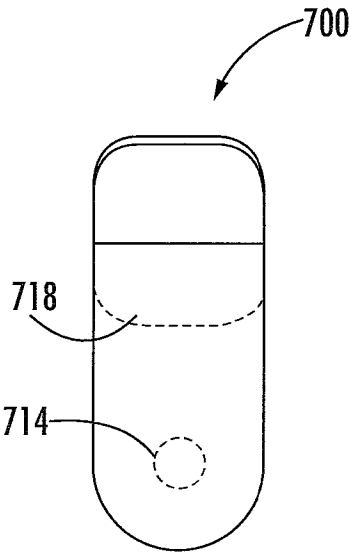
FIG. 7B is a top view of the furniture article of FIG. 7A.
Figure 7A:
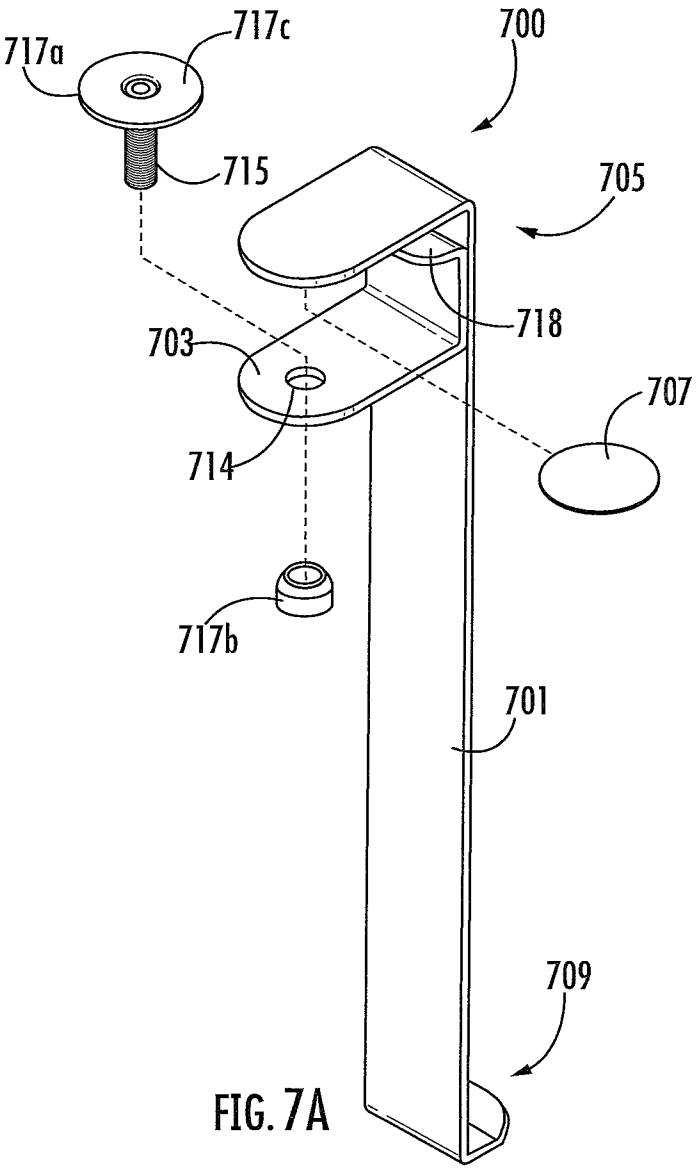
FIG. 7A is a perspective and partial assembly view of another embodiment of a furniture article, according to the present application.
Figure 7C:
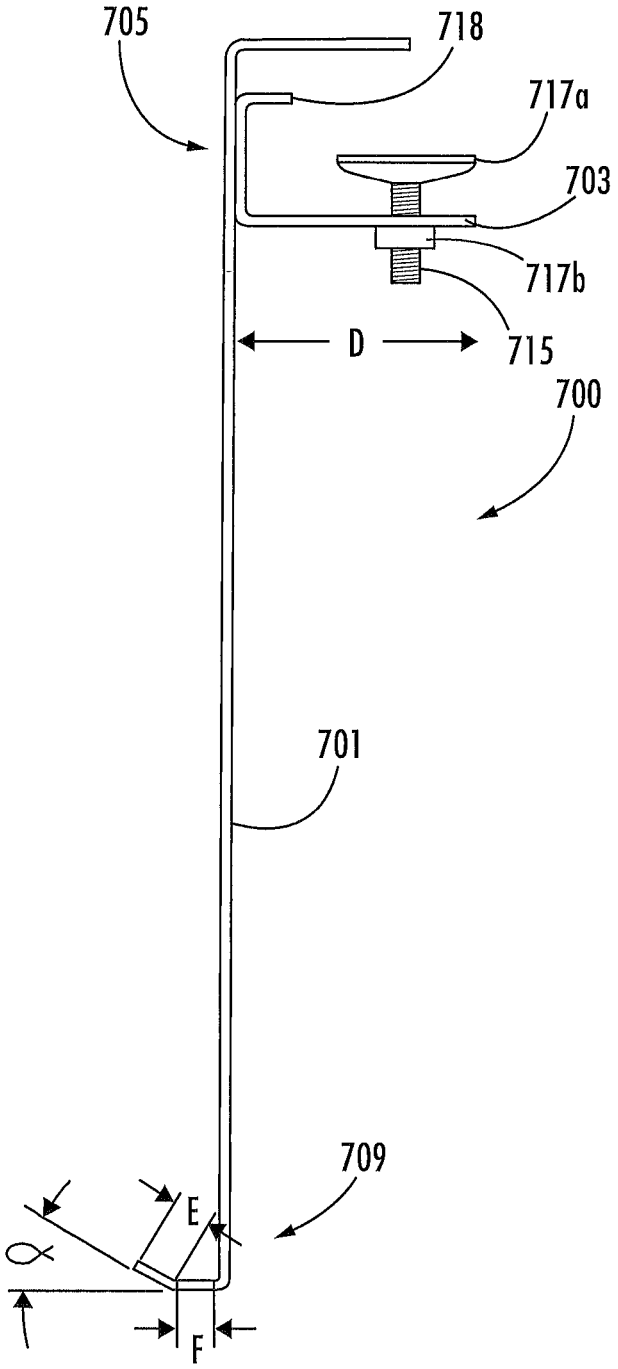
FIG. 7C is an assembled and side view of the furniture article of FIG. 7A.
Figure 7D:
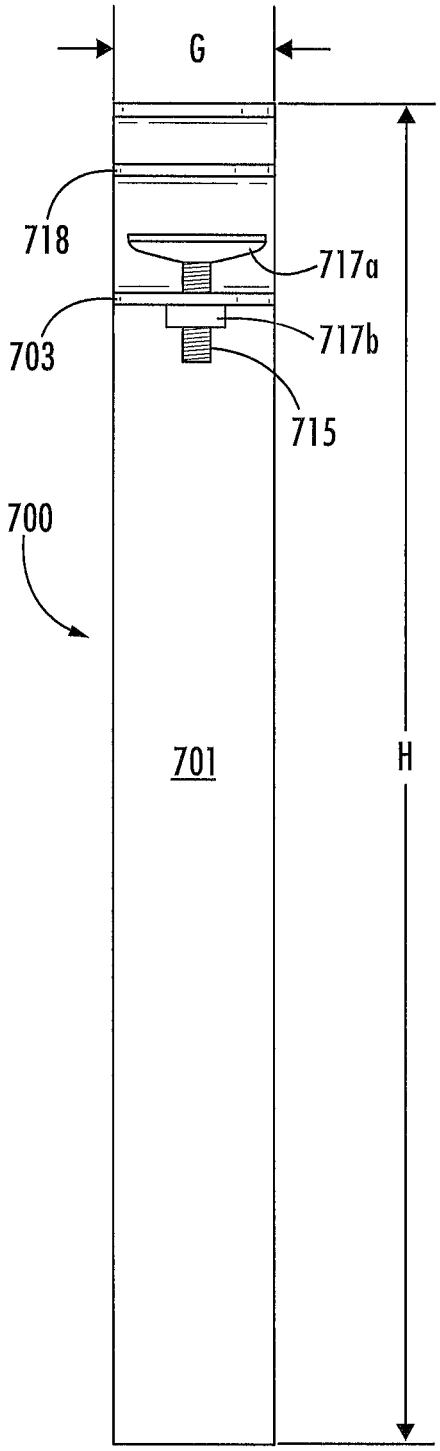
FIG. 7D is a front view of the furniture article of FIG. 7C.

Referring now also to FIG. 7C, receiving end 709 has a dimension, E, that is less than a dimension, E, of an angled panel that is greater than or equal to a width of a horizontal panel having a dimension, F. Angled panel 709 is attached to horizontal panel 703 at an angle, γ, where gamma is preferably 30°, but may be any angle from greater than or equal to 1° to less than or equal to 90°.

Preferably, furniture article 700 is used as a panel support to support a panel, such as panel 109, however, it may also be a standalone article. Preferably, vertical panel 701 of furniture article 700 is formed as a unitary structure, meaning it is bent, folded, or cut from a single piece of ferrous material, and is attached with welds or fasteners to horizontal panel 703. Alternatively, both the vertical and horizontal panels of furniture article 700 are formed as a single, unitary structure, such as an extruded beam having the clamping end and receiving ends shaped according to furniture article 700.

Figure 8A:
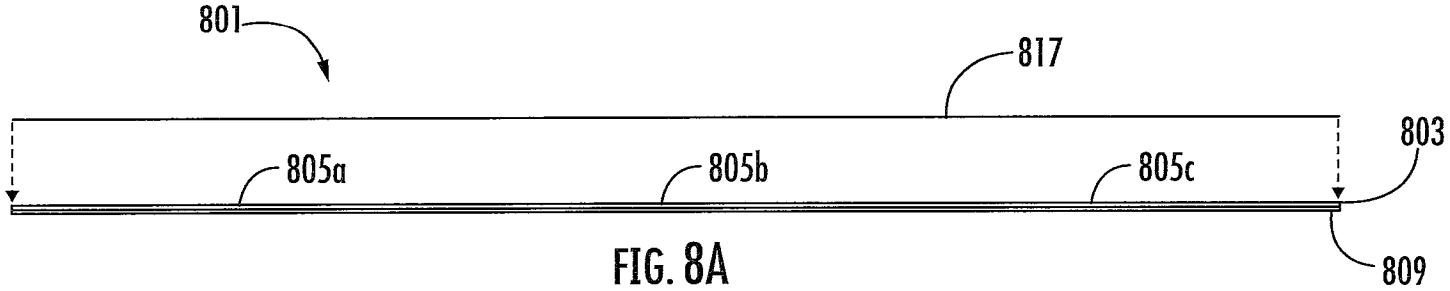
FIG. 8A is a top partial assembly view of a panel, according to the present application.
Figure 8B:
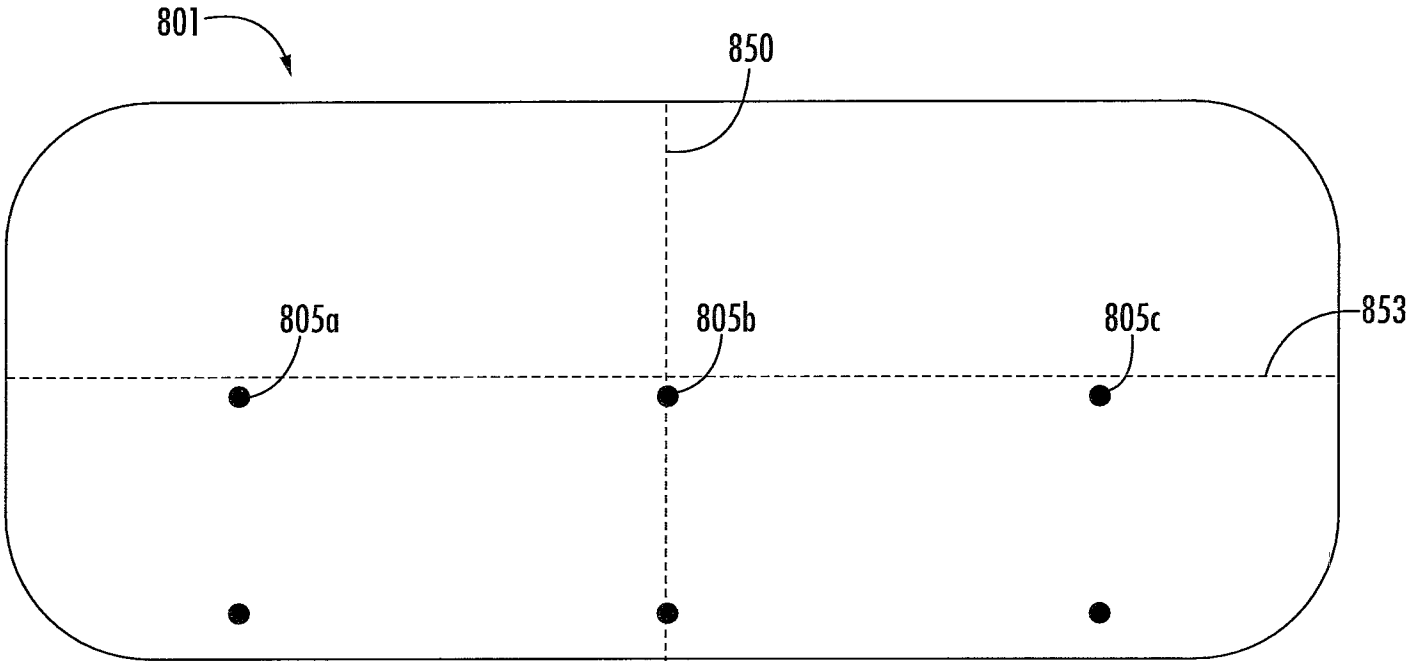
FIG. 8B is a front view of the panel of FIG. 8A.
Figure 8C:
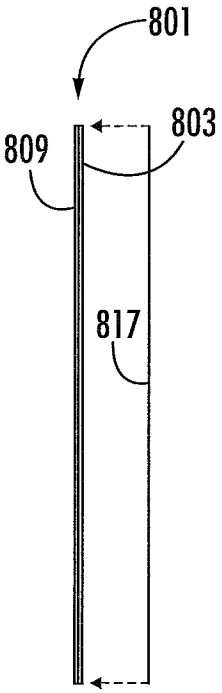
FIG. 8C is an end view partial assembly view of the panel of FIG. 8A.

Referring now also to FIGS. 8A-8C, various views of a panel 801 are depicted. Panel 801 includes a first core panel 803 attached adjacent a second core panel 809, having magnets 805*a*, 805*b*, and 805*c* disposed between panel 801 and panel 809. For acoustic variation or noise reduction, panel 801 includes an exterior layer 817. Preferably, core panels 803 and 809 are made of PET, while exterior layer 817 is felt or another textile material. The dimensions of panel 801 vary depending on the work surface to which it will be attached, but preferably include a panel having a vertical height equal to about ½ the horizontal length. Alternatively, the panel has dimensions of a vertical height that is less than ½ the horizontal length. Alternatively, the panel has dimensions of a vertical height that is greater than ½ the horizontal length. For example, preferred embodiments include panel vertical height and horizontal length dimensions of about 30 in.×60 in., 30 in.×70 in., or 40 in.×70 in.

Panel 801 has a minor axis 850 and a major axis 853. Three or more sets of magnets 805*a*, 805*b*, and 805*c* are positioned relative to the axes 850, 853. For example, a first set 805*a* including one or more magnets (preferably at least two) is positioned beneath major axis 853 and to the left of minor axis 850. Second set 805*b* is positioned beneath major axis 853 and aligned with minor axis 850. Third set 805*c* is positioned beneath major axis 853 and to the right of minor axis 850. Preferably, the sets are spaced apart at equal intervals across the bottom half of panel 801. Preferably, a rubber, plastic, or otherwise flexible framing strip is placed on a portion or all of the perimeter of panel 801. Preferably, panel 801 is used as a rear panel in system 100, but could be used as a standalone article or in different configurations as the configuration depicted in FIG. 1.

Magnets are positioned between the panels, preferably, by using a router or a drill to create a hole or a channel in the panel and placing the magnet therein. Alternatively, the panel is a resin that is poured over the magnets, to completely embed the magnets in panels. Preferably, the magnets are positioned closer to one surface, such as the interior surface, than to the opposing surface. Preferably, the magnets are permanent magnets. Alternatively, electro-magnets are used together with a power source, such as an embedded battery, a power cord to plug into a nearby outlet, and other related components.

Figure 9A:
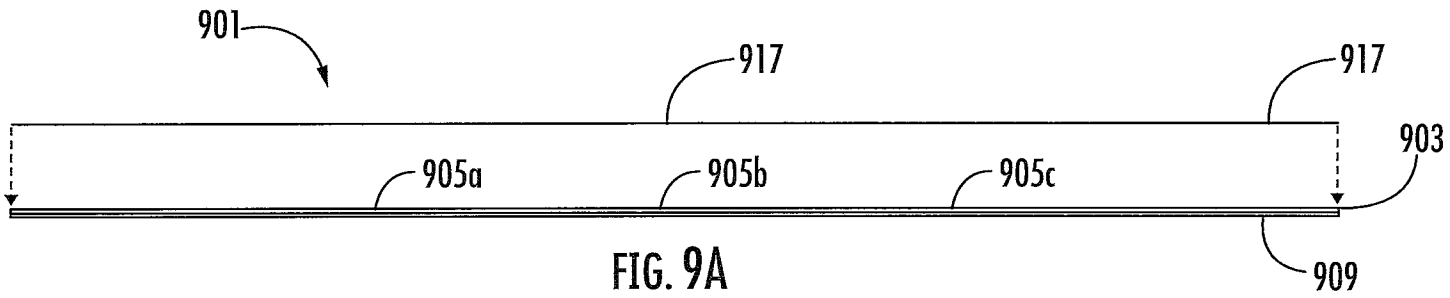
FIG. 9A is a top partial assembly view of a panel, according to the present application.
Figure 9B:
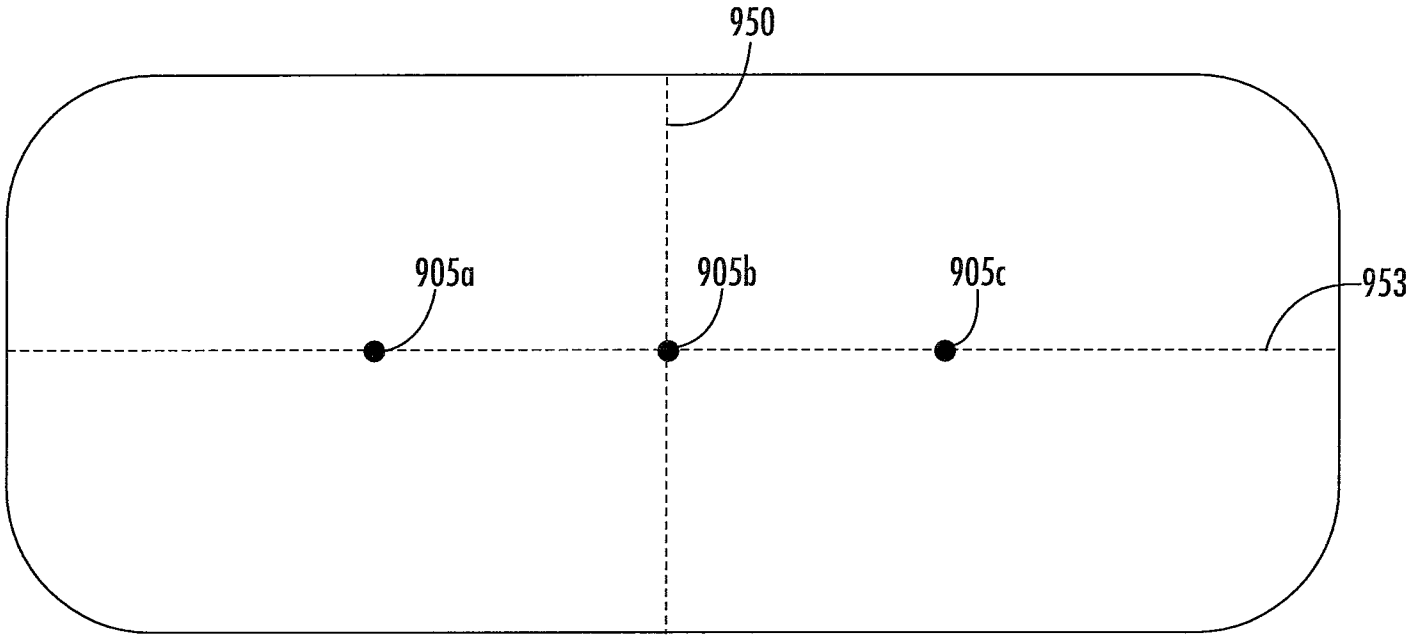
FIG. 9B is a front view of the panel of FIG. 9A.
Figure 9C:
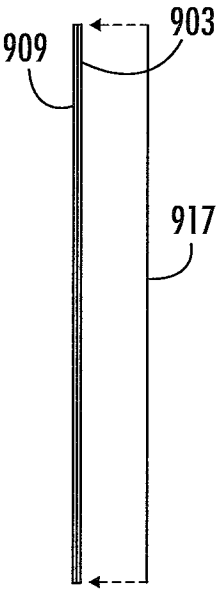
FIG. 9C is an end view partial assembly view of the panel of FIG. 9A.

Referring now also to FIGS. 9A-9C, various views of a panel 901 are depicted. Panel 901 includes a first core panel 903 attached adjacent a second core panel 909, having magnets 905*a*, 905*b*, and 905*c* disposed between panel 901 and panel 909. For acoustic variation or noise reduction, panel 901 includes an exterior layer 917. Preferably, core panels 903 and 909 are made of PET, while exterior layer 917 is felt or another textile material. The dimensions of panel 901 vary depending on the work surface to which it will be attached, but preferably include a panel having a vertical height equal to about ½ the horizontal length. Alternatively, the panel has dimensions of a vertical height that is less than ½ the horizontal length. Alternatively, the panel has dimensions of a vertical height that is greater than ½ the horizontal length. For example, preferred embodiments include panel vertical height and horizontal length dimensions of about 15 in.×30 in., 23 in.×31 in., or 15 in.×31 in.

Panel 901 has a minor axis 950 and a major axis 953. Three or more sets of magnets 905*a*, 905*b*, and 905*c* are positioned relative to the axes 950, 953. For example, a first set 905*a* including one or more magnets (preferably at least one) is positioned aligned with major axis 953 and to the left of minor axis 950. Second set 905*b* is positioned aligned with major axis 953 and aligned with minor axis 950. Third set 905*c* is positioned aligned with major axis 953 and to the right of minor axis 950. Preferably, the sets are spaced apart at equal intervals across the midsection of panel 901. Preferably, a rubber, plastic, or otherwise flexible framing strip is placed on a portion or all of the perimeter of panel 901. Preferably, panel 901 is used as a side panel in system 100, but could be used as a standalone article or in different configurations as the configuration depicted in FIG. 1.

It is important to note that the panel fasteners used herein are hidden from view relative to a user of the workspace. Using hidden fasteners is aesthetically pleasing, and it reduces snags, and in some cases, necessary replacement of worn out fasteners.

It is apparent that an assembly with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

The invention claimed is:

1. A furniture article, comprising:

a first panel;

a work top;

a first panel fastener for releasably attaching the first panel to the work top, the first panel fastener comprising:

a base portion;

a ferrous upright portion extending vertically from the base portion, the upright portion being planar; and a clamp member coupled to the base portion for clamping the panel fastener to the work top; and one or more magnets embedded in a core of the first panel, such that each magnet is disposed wholly within the core;

wherein at least one of the one or more magnets is selectably positioned, such that the first panel is magnetically connected to the upright portion; and wherein the one or more magnets are disposed within the core a distance from the edge.

2. The furniture article of claim 1, wherein the clamp member is hidden from view.

3. The furniture article of claim 1, wherein first panel fastener further comprises:

an elongated portion that extends down below the work top.

4. The furniture article of claim 1, further comprising:

a second panel;

a second panel fastener for releasably attaching the second panel to the work top, the second panel fastener comprising:

a base portion;

a facial support extending out from the base portion; and a clamp member coupled to the base portion for clamping the panel fastener to the work top.

5. A panel fastener system for use with furniture, the panel fastener system comprising:

a base portion;

a clamp member coupled to the base portion for clamping the base portion to the furniture;

a panel coupling member connected to the base portion, the panel coupling member being a vertically planar, ferrous member; and a panel having a core with at least one embedded magnet, such that the panel is magnetically coupled to the panel coupling member;

wherein the at least one embedded magnet is wholly disposed within the core; and wherein the at least one embedded magnet is disposed within the core a distance from the edge.

6. The panel fastener system of claim 5, wherein the panel coupling member is a facial support extending up from the base portion.

7. The panel fastener system of claim 5, wherein the panel coupling member is an elongated panel extending down from the base portion.

* * * * *